United States Patent [19]

Cavallaro

[11] 4,088,184

[45] May 9, 1978

[54] TUBE SUPPORT AND PROTECTION SYSTEM FOR HELICAL COIL HEAT EXCHANGERS

[75] Inventor: Leonardo Cavallaro, La Jolla, Calif.

[73] Assignee: General Atomic Company, San Diego, Calif.

[21] Appl. No.: 665,456

[22] Filed: Mar. 10, 1976

[51] Int. Cl.[2] ..... F28F 9/00

[52] U.S. Cl. ..... 165/162; 122/510

[58] Field of Search ..... 165/156, 162, 163, 172; 248/68 R, 68 CB; 122/510

[56] References Cited

U.S. PATENT DOCUMENTS

| | | | |
|---|---|---|---|
| 1,852,363 | 4/1932 | Parent | 248/68 R |
| 2,980,404 | 4/1961 | Andersen et al. | 165/162 |
| 3,545,534 | 12/1970 | Coles | 165/162 |
| 3,626,481 | 12/1971 | Taylor | 165/162 |
| 3,677,339 | 7/1972 | Perrim et al. | 122/510 |

*Primary Examiner*—Charles J. Myhre
*Assistant Examiner*—Theophil W. Streule, Jr.
*Attorney, Agent, or Firm*—Fitch, Even, Tabin & Luedeka

[57] ABSTRACT

A system is disclosed for supporting and protecting the coaxially disposed helical coils of a heat exchanger arranged with its axis in the vertical direction. The system includes saddle-shaped vertical spacers secured on selected adjacent convolutions of each coil at selected angular positions about the axis of the coils. The vertical spacers are selectively axially aligned to axially support the convolutions of the respective coils, and are cooperable with axially disposed spacer bars between the radially spaced coaxial coils to transfer horizontal and tangential loads between the coils. The tube support system provides vibration damping and facilitates subassembly of different diameter helical coils prior to coaxial assembly thereof into a coil bundle.

12 Claims, 4 Drawing Figures

TUBE SUPPORT AND PROTECTION SYSTEM FOR HELICAL COIL HEAT EXCHANGERS

The present invention relates generally to heat exchangers, and more particularly to a novel system for supporting and protecting the coaxially disposed helical coils in a heat exchanger coil bundle arranged with its axis in the vertical direction.

Heat exchangers of the type employing tube bundles which comprise a plurality of coaxially disposed helical heat exchanger tubes or coils are generally known. The convolutions of the various helical coils are arranged along a common axis with the respective coils being nested within each other to form the tube bundle. In some cases, more than one coil may have the same helical radius such that nesting is effected longitudinally of the tube bundle as well as radially.

In order to maintain the desired axial spacing between the convolutions of the respective coils and to maintain radial spacing between the coaxially disposed coils of different diameters, heat exchangers of the type described generally employ spacer structures. Typical spacer structures used in the prior art have included support plates which are generally disposed radially of the helical coils and have circular openings therein through which the tubes are threaded. Although such support plates have proven generally satisfactory, they exhibit certain disadvantages among which is the necessity for threading the tubes through the support plates which increases both the difficulty and expense of assembly of the tube bundles. Differential thermal stresses among the various tubes necessitates that the prior art support plates be made of high grade structural material. Additionally, some clearance between the respective helical tubes and the support plates through which the tubes are threaded is necessary to permit the threading. Such clearance requires that expensive wear protection devices be employed to prevent undesirable wear between the convolutions of the coils and the support plates. Still further, the use of such support plates does not allow the individual helical coils of different diameters to be assembled independently of each other prior to assembling the respective coils in coaxial relation to form the tube bundles, thus preventing breakdown of the assembly operation into subassembly operations that could be performed concurrently.

One of the primary objects of the present invention is to provide a novel support and protection system for helical coils such as employed in heat exchangers and the like.

Another object of the present invention is to provide a novel system for supporting and protecting the helical coils of a plurality of coaxially disposed coils in a coil bundle, the support and protection system of the invention facilitating subassembly of the individual helical coils prior to assembly in coaxial relation with other helical coils to form the coil bundle of a heat exchanger. Such individual coil subassembly operations can be performed concurrently, thus allowing considerable reductions in the scheduling and capital cost requirements.

A feature of the present invention lies in the use of saddle-shaped vertical spacers which are firmly secured to selected pairs of convolutions of each helical coil by means of tension bands and tensioning devices so as to secure selected adjacent coil convolutions in generally fixed relation. The vertical spacers are positioned at selected angular positions about the axis of the coils and are disposed in axial alignment with other vertical spacers to provide axial support for the coil convolutions. The vertical spacers cooperate with radial spacer bars disposed between the radially spaced coaxial coils to control transverse tube spacing and provide lateral support for the coils of the tube bundle.

Further objects and advantages of the present invention, together with the organization and manner of operation thereof, will become apparent from the following detailed description of one embodiment of the invention when taken in connection with the accompanying drawings wherein like reference numerals designate like elements throughout the several views, and wherein.

Figure 1:
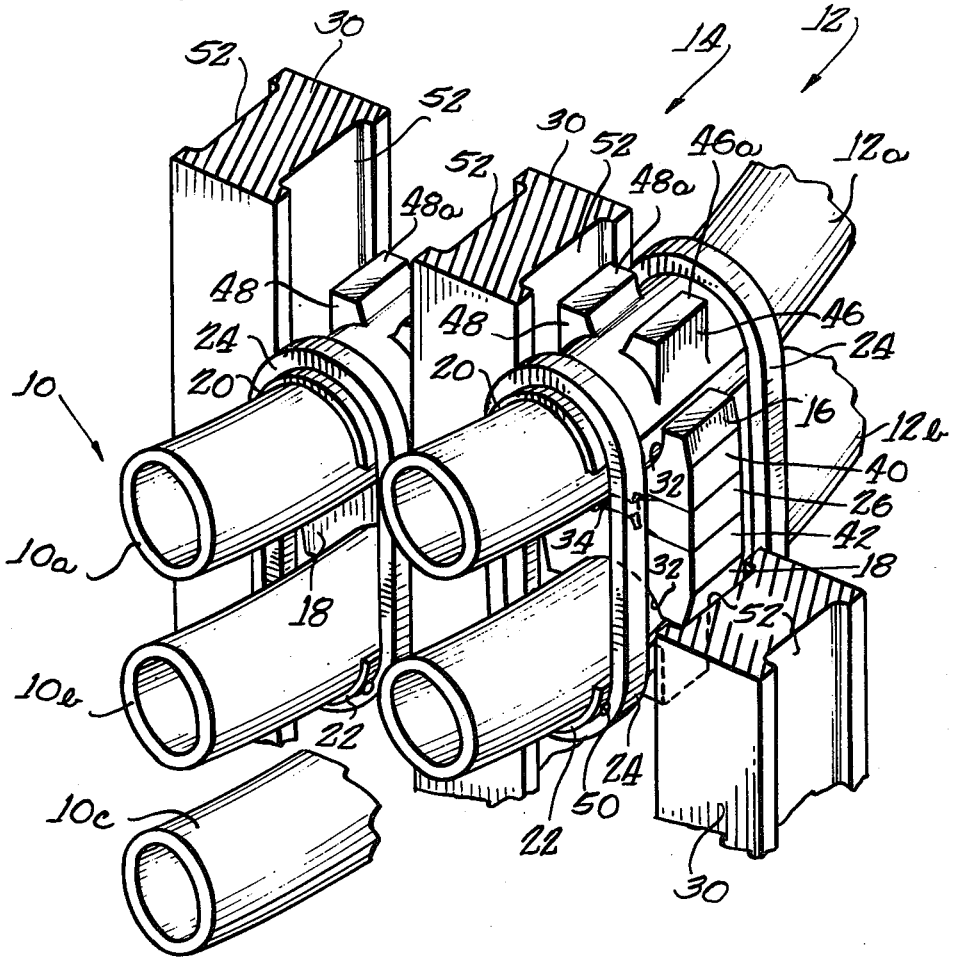
FIG. 1 is a perspective view illustrating a portion of the coaxial helical coils of a heat exchanger employing a coil support and protection system in accordance with the present invention.

Referring now to the drawings, and in particular to FIG. 1, a heat exchanger of the type with which the present invention finds particular application is represented, for purposes of illustration, by portions of two radially adjacent coaxial helical coils, portions of which are indicated generally at 10 and 12. The helical coils 10 and 12, in turn, each comprise a helically wound tube. Three convolutions of helical coil 10 are indicated at 10*a*, 10*b* and 10*c*, while two convolutions of coil 12 are indicated at 12*a* and 12*b*. In final assembly, to be described more fully below, the coils 10 and 12 are disposed in coaxial relation about a generally vertical axis with the tubular convolutions 10*a*, 10*b*, 10*c* and 12*a* and 12*b*, respectively, forming tubular "cylinders" each of which has a different radius of convolution so that the coils are radially spaced from each other. In the illustrated embodiment, the corresponding tube convolutions 10*a* and 12*a*, and 10*b* and 12*b*, etc. are disposed, respectively, in substantially common horizontal planes, it being appreciated that because the respective coils comprise helical convoluted tubes, a single full convolution of each coil does not actually lie in a common plane perpendicular to the axis of the coil.

In practice, more than two helical coils are generally employed in a heat exchanger, with each helical coil having a different radius to facilitate coaxial nesting with the other helical coils. Suitable tubes and headers, not shown, are provided for conducting fluid to and from the helical tubes, such as 10 and 12, as is known in the art. A second fluid is conventionally passed through the radial spaces between the helical coils, usually parallel to the axis of the coils, to effect heat exchange through the walls of the tubes between the two fluids.

The tube convolutions 10*a*, 10*b*, 10*c*, etc. of the helical coil 10, and the tube convolutions 12*a*, 12*b*, etc., of the helical coil 12 are maintained in vertically spaced relation within their respective coils, and the coaxial coils 10 and 12 are maintained in radial spaced relation, by tube support and protection means, indicated generally at 14, constructed in accordance with the present invention. A plurality of tube support and protection means 14 are cooperative with the helical coils comprising the heat exchanger and thus constitute the tube support and protection system of the present invention. As will become more apparent hereinbelow, the tube support and protection means 14 make the respective helical convolutions of the coils vertically "self-supporting" and also serve to transfer horizontal and tangential loads between the "cylindrical layers" of the coil bundle.

Figure 3:
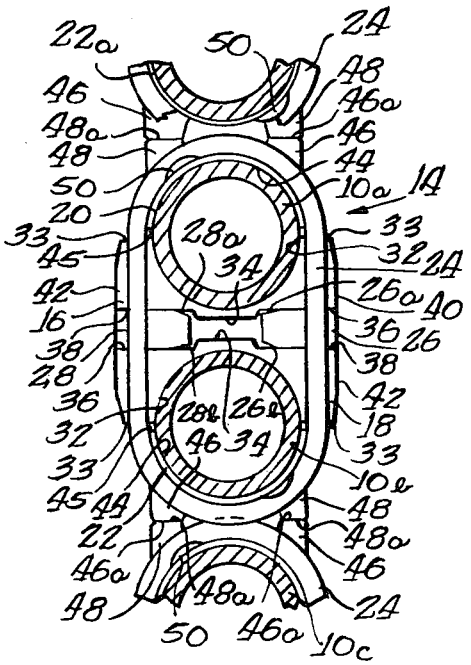
FIG. 3 is a partial vertical sectional view taken substantially along the line 3—3 of FIG. 2, looking in the direction of the arrows.
Figure 2:
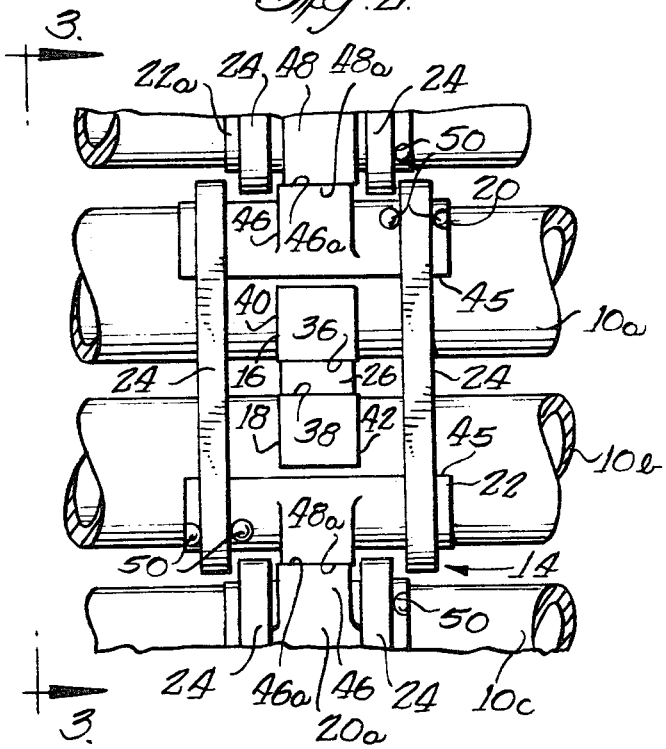
FIG. 2 is a side elevational view showing portions of four adjacent tube convolutions of a helical coil having tube support and protection elements thereon in accordance with the present invention.

With reference to FIGS. 2 and 3, taken in conjunction with FIG. 1, each tube support and protection means 14 includes a pair of identically shaped inner saddle-shaped vertical spacers 16 and 18, a pair of identically shaped outer saddle-shaped vertical spacers 20 and 22, a pair of tension bands or straps 24, and a pair of identically shaped tensioning wedges 26 and 28. The inner and outer vertical spacers 16, 18 and 20, 22, respectively, may alternatively be termed barrel members. The tube support and protection means 14 also include radial spacer bars, shown at 30, which extend axially of the heat exchanger helical coils and are disposed between the radially spaced coaxial coils in cooperative relation with radially aligned inner vertical spacers 16 and 18. The spacer bars 30 may have lengths sufficient to extend the full axial length of the helical coils, or each spacer bar may comprise shorter length segments which are inserted between the coaxial coils in axial alignment, as will become more apparent hereinbelow.

It will be seen that one inner barrel member 16 or 18 and one outer barrel member 20 or 22 are mounted on each of two adjacent convolutions, such as **10*a* and 10*b*, of a helical coil, such as 10. For a selected pair of adjacent coil convolutions, the inner barrel members 16 and 18 are disposed in adjacent opposed relation, such as on the upper surface of the lower tube convolution 10*b* and on the lower surface of the upper tube convolution 10*a*, and each of the outer barrel members 10 and 12 is disposed on its respective coil convolution 10*a* or 10*b* diametrically opposite its associated inner barrel member. Two tension bands 24 are secured about the outer barrel members in a manner to retain two tensioning wedges 26 and 28 between the opposed inner barrel members 16 and 18, the bands 24** and inner and outer barrel members and tensioning wedges thus serving to affix the two adjacent tube convolutions in substantially fixed spaced relation.

The inner saddle-shaped barrel member 16 and 18 take the form of identically shaped support blocks each of which has a semi-cylindrical recess 32 formed in an external surface 33, the recesses 32 being of substantially the same radius as the radius of the associated tubes **10*a* and 10*b* to be received therein. The depth of each recess 32, considered from the associated coplanar surfaces 33 on the inner barrel members, is slightly less than the radius of curvature of the recess. Each of the barrel members 16 and 18 has an external flat surface 34 parallel to the plane of the surfaces 33 and which is recessed along its lateral margins to define coplanar recessed surfaces 36 and 38, as best seen in FIG. 2. When a pair of the inner saddle members 16 and 18 are positioned on their respective adjacent tube convolutions 10*a* and 10*b* in opposed relation, the recessed surface 36 of each inner barrel member is in substantially parallel spaced relation from the recessed surface 38 of the opposed inner barrel member. The opposed recessed surfaces 36 and 38 of the inner barrel members define spaces therebetween which serve to receive the tensioning wedges 26 and 28**.

The inner barrel members 16 and 18 have transverse widths, considered transversely to the axes of their recesses 32, which are greater than the diameters of the associated coil tubes **10*a* and 10*b* such that laterally outwardly projecting locating surfaces 40 and 42 are defined on each of the inner barrel members 16 and 18. The locating surfaces 40 and 42 serve to cooperate with the spacer bars 30 to maintain the spacer bars in substantially fixed radial relation between radially aligned sets of inner barrel members 16 and 18 on adjacent radially spaced helical coil convolutions, such as 10*a*, 12*a* and 10*b*, 12*b***, as will become more apparent below.

The outer saddle-shaped barrel members 20 and 22 are also of substantially identical configuration and each has a semi-cylindrical surface 44 formed therein of a radius substantially equal to the radius of the corresponding tubes **10*a* and 10*b* upon which the outer barrel members are mounted. Each recess 44 has a depth, considered vertically from coplanar surfaces 45 on the outer barrel member, slightly less than the radius of the corresponding recess 44 such that the surfaces 33 and 45 on the inner and outer barrel members, respectively, are spaced apart when the inner and outer barrel members are mounted in pairs on the tube convolutions, such as 10*a* and 10*b***.

Each of the outer barrel members 20 and 22 has a pair of laterally spaced support pads 46 and 48 formed thereon opposite the associated recess 44. The support pads 46 and 48 define support surfaces **46*a* and 48*a*, respectively, thereon which are coplanar and lie in a plane parallel to the plane of the surfaces 45, the plane of surfaces 46*a* and 48*a* being spaced outwardly from the intermediate outer peripheral surface of the barrel member. The support surfaces 46*a* and 48*a* serve to abut the support surfaces 48*a* and 46*a*, respectively, on an opposing outer barrel member when mounted on an adjacent tube convolution, whereby adjacent connected pairs of tube convolutions, such as 10*a* and 10*b***, are supported in spaced relation.

Each of the outer barrel members 20 and 22 has two pairs or sets of outwardly projecting locating dimples 50 provided on its peripheral surface, the dimples of each pair being spaced apart longitudinally along the associated barrel member sufficiently to receive an associated tension band 24 therebetween for maintaining the associated tension band in fixed relation along the length of the outer barrel members. One pair of dimples 50 is preferably provided on each end of the outer barrel members, with the two pairs of dimples on each outer barrel being on opposite sides of the barrel member.

As shown in FIG. 2, the inner barrel members 16 and 18 are made shorter in length, considered in the direction of the axes of the recesses 32, than the outer barrel members 20 and 22. The inner barrel members are made short enough in length so as not to interfere with the tension bands 24 during assembly of the pairs of inner and outer barrel members onto adjacent convolutions of a coil.

As noted, the respective pairs of inner and outer saddle-shaped barrel members 16, 20 and 18, 22 are secured on their respective tube convolutions, such as **10*a* and 10*b*, by the tension bands 24. The tension bands 24 are made of suitable metallic material and form endless or closed loop bands which may be integral or formed from suitable length straps having their ends crimped together to form endless bands prior to assembly onto two adjacent tube convolutions. The bands 24 are preselected such that their peripheral dimensions allow them to be placed over two adjacent tube convolutions, such as 10***a* and 10*b*, and associated outer barrels 20 and 22 during assembly. As will become apparent below, the tension bands 24 are located over selected adjacent convolutions of a coil as it is being formed into a "cylindrical layer" at selected angular intervals relative to the axis of the coil being formed. The tensioning wedges 26 and 28 are adapted to be inserted between opposed surfaces 36 and 38 of the opposed inner barrel members 16 and 18 during assembly of the tube support and protection means 14 onto a helical coil. Noting FIG. 3, the wedges 26 and 28 have beveled forward corner surfaces 26*a*, 26*b* and 28*a*, 28*b*, respectively, formed thereon to facilitate assembly. The vertical thickness of the wedges 26 and 28 is selected such that when the wedges 26 and 28 are assembled in place between opposed inner barrel members 16 and 18, the tension band is made to slightly elongate, thereby generating a tension that prevents relative movement between the respective tube convolutions, such as 10*a* and 10*b*, and 12*a* and 12*b*, and their associated inner and outer barrel members.

While the description thus far presented has discussed axially adjacent tube convolutions, such as 10*a*, 10*b* and 12*a*, 12*b*, it will be understood that the adjacent tube convolutions need not be of the same tubular coil. Frequently, each "cylindrical layer" is formed by threading two or more helical coils of the same convolution radius through a support fixture so as to coaxially "nest" the different helical coils. In this manner, the adjacent tube convolutions of a cylindrical layer which are connected as herein described may be portions of different helical coils.

In assembling each of the helical coils, such as depicted generally at 10 and 12, into their helical configurations prior to final assembly of the helical coils in coaxial relation to form a coil bundle, each "cylindrical layer" is subassembled separately, with access for subassembly being available both from inside and outside the respective helical coils. When it is desired to assemble two coils of the same helical radius into coaxial nested relation to each other, the coils may be threaded through a support fixture (not shown) which may consist of a set of comb-like supports, or a set of stacks of grooved rollers, as is known. During threading of the coils, tension bands 24 are positioned over the tubes at appropriate angular intervals about the circumference of each coil, the tension bands being disposed to connect alternate pairs of coil convolutions such that if two adjacent tube convolutions, such as 10*a* and 10*b*, are connected at one angular position by a pair of tension bands 24, these same two adjacent tube convolutions will not be linked together at the next angular support position, and vice versa. For example, if the tube convolutions 10*a* and 10*b* of the helical coil 10 have a pair of tension bands 24 placed thereover during subassembly into the cylindrical layer 10, the tube convolution 10*b* and the next below tube convolution, indicated partially at 10*c*, would have a pair of tension bands 24 placed thereabout at a predetermined next angular or azimuth position about the axis of the helical coil 10 circumferentially spaced from the illustrated tension bands 24.

After the tension bands 24 are placed over alternate adjacent pairs of tube convolutions within a cylindrical layer being subassembled, the inner and outer barrel members 16, 18 and 20, 22 are positioned on the coil convolutions at discrete azimuth locations about the axis of the cylindrical layer or coil. The selected angular or azimuth locations of the inner and outer barrels may be the same angular locations where radial support plates as known in the prior art are positioned.

To minimize the axial length of a helical coil being assembled into a cylindrical layer, the outer barrel members 20 and 22 of alternate connected pairs of tube convolutions are made of shorter longitudinal length, considered along the axes of recesses 44, than the other outer barrel members, as illustrated by the outer barrels 20*a* and 22*a* of FIG. 2. In this manner, the tension bands 24 associated with the shorter length outer barrel members 20*a* and 22*a* are disposed between the tension bands 24 associated with the alternate longer length outer barrel members, such as 20 and 22. The short outer barrel members 20*a* and 22*a* are substantially identical in other respects to the longer length barrel members 20 and 22 except that the shorter length barrel members 20*a* and 22*a* need only be provided with single retention dimples 50. In this respect, the outer barrel members are alternatively "long" and "short" in order to allow overlapping between the tension bands 24 of adjacent pairs of connected tube convolutions, with a resulting reduction in the coil bundle axial length as compared to the prior art plate type coil support systems.

After placing the barrel members onto the coil convolutions, the associated tension bands 24 are slid over the outer barrel members such that the "short" barrels 20*a* and 22*b* are linked together before linking of the "long" barrel members 20 and 22. The dimples 50 provided on the outer peripheral surfaces of the outer barrel members locate and retain the associated tension bands 24 in their assembled positions.

A feeler gauge is next inserted between the opposed surfaces 34 of the inner barrel members 16 and 18 on each adjacent pair of tube convolutions, and tensioning wedges 26 and 28 of appropriate vertical thickness are selected for insertion between the opposing surfaces 36 and 38 of the associated inner barrel members 16 and 18. The wedges 36 and 38 are selected such that when driven into place between the inner barrel members 16 and 18, the desired preload of the tension bands 24 is obtained. The preload of each pair of adjacent connected tube convolutions resulting from assembly of the tensioning wedges 36 and 38 between the associated inner barrel members may be adjusted by varying the vertical thickness of the wedges 26 and 28. A limited assortment of wedge thicknesses would be sufficient to provide a substantially uniform preload over a wide range of tube, barrel member and tension band tolerances. By such preload control, yielding of the tension bands 24 can be prevented. Yielding of the tension bands can also be minimized by providing tension bands of suitable flexibility characteristics and by matching of the coefficients of expansion of the respective components of each tube support and protection means assemblage 14.

Once the tensioning wedges 26 and 28 are inserted between the associated inner barrel members 16 and 18 on the connected adjacent tube convolutions, assembly of the cylindrical layer is completed. The assembled cylindrical layer is then lifted by suitable means (not shown) and lowered coaxially over a previously similarly prepared cylindrical layer of smaller helical diameter to position the coaxially disposed cylindrical layers in desired radial spaced relation. The coaxially disposed helical coils are positioned so that the axially aligned tube support and protection means 14 of the various coils are radially aligned with each other, although tube support and protection means 14 need not be provided to extend in radial alignment all the way from the inner to the outer helical coil at each selected azimuth location in the tube bundle. Next, the spacer bars 30 are inserted axially between the coaxially positioned cylindrical layers, the spacer bars being inserted lengthwise from either end of the assembled helical coil layers.

Figure 4:
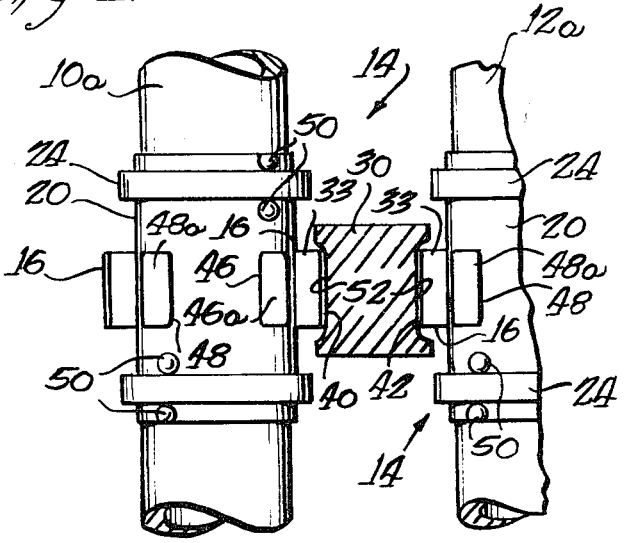
FIG. 4 is a partial sectional view taken transversely of a helical coil bundle showing two radially adjacent coaxial tube convolutions maintained in radial spaced relation by a radial spacer bar of the invention.

With reference to FIGS. 1 and 4, it can be seen that the spacer bars 30 may be of generally square or rectangular cross sectional configuration and have recessed surface areas 52 of identical configuration formed in oppositely facing longitudinal surfaces thereof. The recesses 52 are of suitable size and configuration to receive and cooperate with opposing projecting locating surfaces 40 and 42 on adjacent radially aligned inner barrel members 16 and 18 of the coaxially disposed helical coils. As noted, the spacer bars 30 may be made of a longitudinal length equal to the overall axial length of the associated helical coils between which the spacer bars are inserted, or the spacer bars may be of selected shorter length sections which are inserted in axial alignment with each other to extend the full axial lengths of the associated helical coils. The laterally projecting surfaces 40 and 42 on the inner barrel members 16 and 18 act as guide tracks for the spacer bars. The spacer bars 30 serve to trap the tensioning wedges 26 and 28 between the inner barrel members 16 and 18 when the spacer bars are inserted axially between the radially spaced helical coils so that no other retention means are necessary for the wedges.

With a heat exchanger having its respective coaxially disposed helical coils secured in accordance with the present invention as aforedescribed, no relative movement between the tube convolutions and their respective attached inner and outer barrel members will take place. The only relative movement between the various elements will take place between the abutting support pads 46 and 48 of the adjacent opposed outer barrel members such as 20, 22 and **20*a*, 22*a*. To prevent excessive wear, the support surfaces 46*a* and 48*a* on the support pads 46 and 48 are preferably specially treated to minimize wear. The locating surfaces 40 and 42 on the inner barrel members 16 and 18 are also similarly treated to reduce wear between the locating surfaces and the recessed surfaces 52 of the associated spacer bars 30**. For example, the wear surfaces may be spray coated although other surface treatment for the prevention of wear could also be effected.

Should flow-induced vibrations occur during operation of a heat exchanger assembled as above described, the various pairs of tube convolutions, such as **10*a* and 10*b*, which are linked by tension bands 24 and associated inner and outer barrel members will vibrate together at the azimuth positions where the tube support and protection means 14 are mounted. As noted, each helical coil in a tube bundle has alternate pairs of tube convolutions connected, as considered at successive azimuth positions about the axis of the coil, such that bundle flexibility with respect to tube vibration is retained. The vibrations are damped by friction occurring at the support pad interfaces 46*a* and 48*a*, and at the contact surfaces between the inner barrel locating surfaces 40 and 42 and the recessed surfaces 52 on the associated spacer bars 30. The spacer bars 30 serve to maintain the desired radial spacing of the coaxially disposed helical tubes and also provide lateral support for the helical tubes such that horizontal and tangential load forces to which the helical coils might be subjected are transferred between the helical coil "layers" through the spacer rods 30**. External lateral support for the tube bundle of the heat exchanger assembly may be provided from either within the innermost helical coil or externally of the outermost helical coil of the coaxially disposed coils, or at both positions.

Although the tube walls of the respective helical coils form part of the vertical load paths for the helical coils, the resulting compressive stress is quite modest. Tube flattening bending stresses are substantially eliminated by peripheral placing of the support pads 46 and 48 formed integral with the outer barrel members such as shown at 20, 22, **20*a* and 20*b*. The vertical loads on the respective helical coils of the coil bundle may be ultimately transmitted to radial gussets arranged in a star pattern beneath the coil bundle. Earthquake loads are transmitted to shrouds (not shown) via the inner barrel members 16 and 18 and the spacer bars 30**. Such horizontal load transfer does not introduce moments in the coil bundle structure and is accompanied by friction damping as aforedescribed.

As noted, while the tube support and protection assemblages 14 on each pair of adjacent coil convolutions have been described as being disposed in generally radial relation at various angular positions about the axis of the helical coils, the support and protection assemblages need not extend all the way from the inner to the outermost helical coil, but might extend only partially through the radial dimension of the coil bundle.

Thus, in accordance with the present invention, a tube support and protection system is provided which eliminates the use of radially disposed support plates with their attendant drilling requirements and threading - through of the convoluted tubes as is required by the prior art. The coil bundle length is significantly shortened by elimination of lengthwise support plate elements. Subassembly of each of the "cylindrical layers" or helical coils before axial assembly into the coil bundle is readily accomplished with resultant access for subassembly from both inside and outside of the respective helical coils.

While one embodiment of the present invention has been illustrated and described, it will be understood to those skilled in the art that changes and modifications may be made therein without departing from the invention in its broader aspects. Various features of the invention are defined in the following claims.

What is claimed is:

1. In a heat exchanger, a tube bundle comprising at least one helical coil having a plurality of tube convolutions, a plurality of discrete tube support members selectively disposed on adjacent tube convolutions of said helical coil at selected azimuth positions about the axis of said coil, means securing said discrete support members on selected pairs of adjacent tube convolutions so as to secure the tube convolutions of each of said selected pairs of tube convolutions in substantially fixed spaced relation with each of said selected pairs being secured together independently of the other selected pairs of tube convolutions, said support members at each selected azimuth position being disposed in axially aligned relation along the axial length of the coil and cooperating to support said tube convolutions in the axial direction of said coil at said azimuth positions.

2. In a heat exchanger, a tube bundle comprising at least one helical coil having a plurality of tube convolutions, a plurality of tube support members comprising pairs of inner and outer saddle-shaped barrel members selectively disposed on adjacent tube convolutions of said helical coil at selected azimuth positions about the axis of said coil, means securing said pairs of inner and outer saddle-shaped barrel members on selected pairs of adjacent tube convolutions so as to secure the tube convolutions of each of said selected pairs of tube convolutions in substantially fixed spaced relation with said inner barrel members on each pair of secured tube convolutions being disposed in opposed relation, said inner and outer saddle-shaped barrel members at each selected azimuth position being disposed in axially aligned relation along the axial length of the coil and cooperating to support said tube convolutions in the axial direction of the coil at said selected azimuth positions, said outer barrel members on each of said pairs of secured tube convolutions being disposed in substantially diametrically opposite relation to an associated one of said inner barrel members, spacer means disposed between said opposed inner barrel members, said securing means comprising strap means cooperative with said pairs of inner and outer barrel members so as to maintain said pairs of barrel members in said substantially fixed spaced relation on their respective tube convolutions.

3. In a heat exchanger, a tube bundle comprising at least one helical coil having a plurality of tube convolutions, a plurality of tube support members selectively disposed on adjacent tube convolutions of said helical coil at selected azimuth positions about the axis of said coil, endless bands disposed about said pairs of tube support members and securing said support members on selected pairs of adjacent tube convolutions so as to secure the tube convolutions of each of said selected pairs of tube convolutions in substantially fixed spaced relation, said support members at each selected azimuth position being disposed in axially aligned relation along the axial length of the coil and cooperating to support the tube convolution in the axial direction of said coil at said selected azimuth position.

4. Apparatus as defined in claim 1 wherein said tube bundle includes a plurality of coaxial helical coils each of which has a different radius of convolution than the other coils in the tube bundle, a plurality of said tube support members being selectively disposed on adjacent tube convolutions of each of said coaxial helical coils, said support members on said coaxial coils being radially aligned at selected azimuth positions about the axis of the tube bundle, and including axially disposed spacer means between said coaxial coils and cooperable with said radially aligned support members to maintain said coils in substantially fixed radial spaced relation.

5. Apparatus as defined in claim 4 wherein selected ones of said tube support members have locating surfaces thereon which extend in the radial direction from the axis of said coaxial coils, said spacer means being cooperative with said locating surfaces on said radially aligned tube support members.

6. Apparatus as defined in claim 5 wherein said spacer means include a plurality of elongated spacer members each of which is disposed between adjacent coaxial coils of said tube bundle and is cooperative with the locating surfaces on adjacent radially aligned support members so as to maintain said spacer members in fixed azimuth relation relative to the axis of said tube bundle.

7. Apparatus as defined in claim 2 wherein each of said outer barrel members has a projecting abutment thereon extending in the axial direction of said helical coil, said projecting abutments on each pair of said second barrel members being disposed to engage a projecting abutment on an opposed adjacent second barrel member of the adjacent pairs of axially aligned inner and outer barrel members such that axial loads on said coil are transferred between adjacent pairs of secured tube convolutions through said abutting projecting abutments.

8. Apparatus as defined in claim 2 wherein said inner and outer barrel members have generally semi-cylindrical shaped surfaces for engagement with the peripheral surfaces of the associated tube convolutions.

9. Apparatus as defined in claim 2 wherein said strap means are secured about said outer barrel members on each pair of secured tube convolutions, said outer barrel members having strap retention means thereon preventing movement of said strap means along the longitudinal lengths of said outer barrel members.

10. A tube support and protection system for axially supporting the tube convolutions of a helical tubular coil, comprising, in combination, a plurality of inner barrel members each of which has a generally arcuate surface adapted for engagement with the peripheral surface of a portion of a tube convolution, a plurality of outer barrel members each of which has a generally arcuate surface adapted for engagement with the peripheral surface of a portion of a tube convolution, said outer barrel members each having a projecting abutment thereon, said inner and outer barrel members being disposed in pairs on selected pairs of adjacent tube convolutions at selected azimuth positions about the axis of the helical coil such that the inner barrel members on said adjacent tube convolutions are in opposed relation and the outer barrel members of said pairs of inner and outer barrel members are diametrically opposite their associated inner barrel members, strap means securing said pairs of inner and outer barrel members on said pairs of adjacent tube convolutions and adapted to prevent relative motion between said inner and outer barrel members and their respective tube convolutions and also prevent relative movement between the adjacent tube convolutions of each of said selected pairs of tube convolutions, and tensioning means disposed between said opposed inner barrel members on each said pair of adjacent tube convolutions to maintain said strap means in sufficient tension to prevent said relative movement.

11. A system as defined in claim 10 wherein said pairs of inner and outer barrel members are secured to selected pairs of adjacent tube convolutions along the full axial length of said helical coil at each of said selected azimuth positions.

12. A system as defined in claim 10 wherein a plurality of helical tubular coils of different coil diameter are disposed in coaxial radially spaced relation, each of said tubular coils having its tube convolutions secured in selected pairs by pairs of said inner and outer barrel members and associated spacer means and strap means at selected azimuth positions relative to the axis of the coil, said selected azimuth positions being substantially identical for each coil, said coaxial coils being positioned with their respective pairs of inner and outer barrel members in radial alignment with pairs of inner and outer barrel members on the adjacent coaxial coils, and including spacer means extending axially of said coaxial coils between said radially spaced coils and being cooperative with said barrel members to maintain said coils in generally fixed spaced relation to each other.

* * * * *